US010989195B2

(12) United States Patent
Kawashima et al.

(10) Patent No.: US 10,989,195 B2
(45) Date of Patent: Apr. 27, 2021

(54) IN-VEHICLE MOTOR-DRIVEN COMPRESSOR AND METHOD FOR CONTROLLING IN-VEHICLE MOTOR-DRIVEN COMPRESSOR

(71) Applicant: KABUSHIKI KAISHA TOYOTA JIDOSHOKKI, Kariya (JP)

(72) Inventors: Takashi Kawashima, Kariya (JP); Kazuki Najima, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 256 days.

(21) Appl. No.: 16/298,385

(22) Filed: Mar. 11, 2019

(65) Prior Publication Data

US 2019/0285069 A1 Sep. 19, 2019

(30) Foreign Application Priority Data

Mar. 14, 2018 (JP) ..... JP2018-046522

(51) Int. Cl.
*F04C 28/08* (2006.01)
*F04C 28/28* (2006.01)
(Continued)

(52) U.S. Cl.
CPC ..... *F04C 28/08* (2013.01); *F04C 14/08* (2013.01); *F04C 28/06* (2013.01); *F04C 28/28* (2013.01);
(Continued)

(58) Field of Classification Search
CPC ..... F04C 18/0215; F04C 28/06; F04C 28/08; F04C 2240/403; F04C 29/0085; F04C 2240/40; F04C 23/008; F04C 28/28; F04C 2240/808; F04C 2240/81; F04C 2270/0525; F04C 2270/605; F04C 2270/051; F04C 2270/075; F04C 2270/19; F04C 2270/195; F04C 14/08
See application file for complete search history.

(56) References Cited

U.S. PATENT DOCUMENTS 5,875,414 A 2/1999 Tsutsumi
5,904,050 A * 5/1999 Nathan ..... B60H 1/3222 60/449
(Continued)

FOREIGN PATENT DOCUMENTS

CN 1307783 C 3/2007
JP 9-233832 A 9/1997
(Continued)

*Primary Examiner* — Peter J Bertheaud
(74) *Attorney, Agent, or Firm* — Sughrue Mion, PLLC

(57) ABSTRACT

An in-vehicle motor-driven compressor includes a temperature rise estimator configured to estimate a temperature rise of the diode based on an expected reverse current, an on-voltage of the diode, and a heat resistance of the diode. The in-vehicle motor-driven compressor further includes a rotation speed controller configured to set a rotation speed limit of the electric motor, based on the estimated temperature rise of the diode so that a temperature of the diode does
(Continued)

not exceed a junction temperature of the diode even when the electric motor is stopped and the reverse current flows through the diode, and limit a rotation speed of the electric motor to lower than or equal to the rotation speed limit.

4 Claims, 3 Drawing Sheets

(51) Int. Cl.

| | |
|---|---|
| ***F04C 28/06*** | (2006.01) |
| ***F04C 29/00*** | (2006.01) |
| ***F04C 14/08*** | (2006.01) |
| *F04C 18/02* | (2006.01) |
| *F04C 23/00* | (2006.01) |

(52) U.S. Cl.
CPC ..... *F04C 29/0085* (2013.01); *F04C 18/0207* (2013.01); *F04C 18/0215* (2013.01); *F04C 23/008* (2013.01); *F04C 2240/40* (2013.01); *F04C 2240/403* (2013.01); *F04C 2240/808* (2013.01); *F04C 2270/051* (2013.01); *F04C 2270/0525* (2013.01); *F04C 2270/075* (2013.01); *F04C 2270/19* (2013.01); *F04C 2270/195* (2013.01); *F04C 2270/605* (2013.01)

(56) References Cited

U.S. PATENT DOCUMENTS

| | | | | |
|---|---|---|---|---|
| 6,526,772 | B2 * | 3/2003 | Suitou | F04B 49/02 62/228.4 |
| 9,024,598 | B2 * | 5/2015 | Hasegawa | H02M 1/32 323/272 |
| 9,931,944 | B2 * | 4/2018 | Alam | B60L 7/18 |
| 10,087,935 | B2 * | 10/2018 | Ichihara | F04C 28/28 |
| 10,250,174 | B2 * | 4/2019 | Sakai | F25B 13/00 |
| 2004/0124808 | A1 | 7/2004 | Hirono | |
| 2015/0159655 | A1 | 6/2015 | Yano et al. | |
| 2017/0058899 | A1 * | 3/2017 | Ichihara | F04C 28/06 |
| 2017/0274777 | A1 * | 9/2017 | Alam | B60L 15/007 |
| 2017/0284409 | A1 | 10/2017 | Kawashima et al. | |
| 2018/0156217 | A1 * | 6/2018 | Sakima | F04C 29/0007 |
| 2018/0175766 | A1 * | 6/2018 | Sakai | F25B 13/00 |

FOREIGN PATENT DOCUMENTS

| | | | |
|---|---|---|---|
| JP | 2007-288858 | A | 11/2007 |
| JP | 2014-88160 | A | 5/2014 |
| JP | 2015-109776 | A | 6/2015 |
| JP | 2017-180211 | A | 10/2017 |

* cited by examiner

IN-VEHICLE MOTOR-DRIVEN COMPRESSOR AND METHOD FOR CONTROLLING IN-VEHICLE MOTOR-DRIVEN COMPRESSOR

BACKGROUND

The following description relates to an in-vehicle motor-driven compressor and a method for controlling the in-vehicle motor-driven compressor.

An in-vehicle motor-driven compressor includes a compression unit that compresses a fluid and an electric motor that drives the compression unit. Japanese Laid-Open Patent Publication No. 2017-180211 describes an example of an in-vehicle motor-driven compressor including an inverter that drives the electric motor. The inverter includes switching elements that perform switching to drive the electric motor and diodes that are connected in parallel to the switching elements. The switching elements perform switching so that the inverter converts the DC voltage from a vehicle battery into AC voltage. The obtained AC voltage is applied to the electric motor as a drive voltage so as to drive and control the electric motor.

The in-vehicle motor-driven compressor is supplied with power from the vehicle battery and thus affected by the input voltage from the battery. The voltage of the vehicle battery changes in accordance with the condition of the vehicle. This may decrease the input voltage from the battery input to the in-vehicle motor-driven compressor. When the input voltage of the battery that is input to the in-vehicle motor-driven compressor is low and the electric motor is stopped while operating at a high rotation speed, a voltage of a back electromotive force (back electromotive voltage) of the electric motor will exceed the input voltage of the battery. This causes a reverse current to flow from the electric motor via an inverter to the vehicle battery. Specifically, when the electric motor is stopped, the switching elements do not perform the switching. This causes the reverse current to flow from the electric motor via the diodes to the battery. When the back electromotive voltage of the electric motor is high, excessive reverse current flows through the diodes. The diodes may break if the temperature of the diodes exceeds a junction temperature of the diodes.

In this respect, for example, the maximum rotation speed of the electric motor may be limited in accordance with the input voltage of the battery. However, in this case, even in situations in which more power can be supplied from the vehicle battery to the in-vehicle motor-driven compressor, the limit on the maximum rotation speed will be set in accordance with the input voltage of the battery. This narrows the operation range of the in-vehicle motor-driven compressor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the following description to provide an in-vehicle motor-driven compressor and a method for controlling the in-vehicle motor-driven compressor that widens the operation range of the in-vehicle motor-driven compressor and avoids diode breakage when an input voltage of a battery is low and an electric motor is stopped while operating at a high rotation speed.

According to one general aspect, an in-vehicle motor-driven compressor includes a compression unit, an electric motor, and an inverter. The compression unit is configured to compress a fluid. The electric motor is configured to drive the compression unit. The inverter is configured to drive the electric motor. The inverter includes a switching element and a diode. The switching element is configured to perform switching and convert DC voltage of a battery into AC voltage to drive the electric motor. The diode is connected in parallel to the switching element. The in-vehicle motor-driven compressor further includes a temperature rise estimator and a rotation speed controller. The temperature rise estimator is configured to estimate a temperature rise of the diode based on an expected reverse current, an on-voltage of the diode, and a heat resistance of the diode. The reverse current is a current that flows from the electric motor via the diode to the battery when the electric motor is stopped and a back electromotive voltage of the electric motor exceeds an input voltage of the battery. The rotation speed controller is configured to set a rotation speed limit of the electric motor, based on the estimated temperature rise of the diode so that a temperature of the diode does not exceed a junction temperature of the diode even when the electric motor is stopped and the reverse current flows through the diode, and limit a rotation speed of the electric motor to lower than or equal to the rotation speed limit.

According to another general aspect, a method for controlling an in-vehicle motor-driven compressor is provided. The in-vehicle motor-driven compressor includes a compression unit, an electric motor, and an inverter. The compression unit is configured to compress a fluid. The electric motor is configured to drive the compression unit. The inverter is configured to drive the electric motor. The inverter includes a switching element and a diode. The switching element is configured to perform switching and convert DC voltage of a battery into AC voltage to drive the electric motor. The diode is connected in parallel to the switching element. The method includes estimating a temperature rise of the diode based on an expected reverse current, an on-voltage of the diode, and a heat resistance of the diode. The reverse current is a current that flows from the electric motor via the diode to the battery when the electric motor is stopped and a back electromotive voltage of the electric motor exceeds an input voltage of the battery. The control method further includes setting a rotation speed limit of the electric motor based on the estimated temperature rise of the diode so that a temperature of the diode does not exceed a junction temperature of the diode even when the electric motor is stopped and the reverse current flows through the diode, and limiting a rotation speed of the electric motor to lower than or equal to the rotation speed limit.

According to another general aspect, an in-vehicle motor-driven compressor includes a compression unit, an electric motor, and an inverter. The compression unit is configured to compress a fluid. The electric motor is configured to drive the compression unit. The inverter is configured to drive the electric motor. The inverter includes a switching element and a diode. The switching element is configured to perform switching and convert DC voltage of a battery into AC voltage to drive the electric motor. The diode is connected in parallel to the switching element. The in-vehicle motor-driven compressor includes circuitry configured to estimate a temperature rise of the diode based on an expected reverse current, an on-voltage of the diode, and a heat resistance of the diode. The reverse current is a current that flows from the electric motor via the diode to the battery when the electric motor is stopped and a back electromotive voltage of the electric motor exceeds an input voltage of the battery. The circuitry is configured to set a rotation speed limit of the electric motor, based on the estimated temperature rise of the diode so that a temperature of the diode does not exceed a junction temperature of the diode even when the electric motor is stopped and the reverse current flows through the diode, and limit a rotation speed of the electric motor to lower than or equal to the rotation speed limit.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

An in-vehicle motor-driven compressor according to one embodiment will now be described with reference to FIGS. 1 to 4. The in-vehicle motor-driven in the present embodiment, that is, a motor-driven compressor configured to be mounted in an vehicle, is for example used with a vehicle air conditioner.

Figure 1:
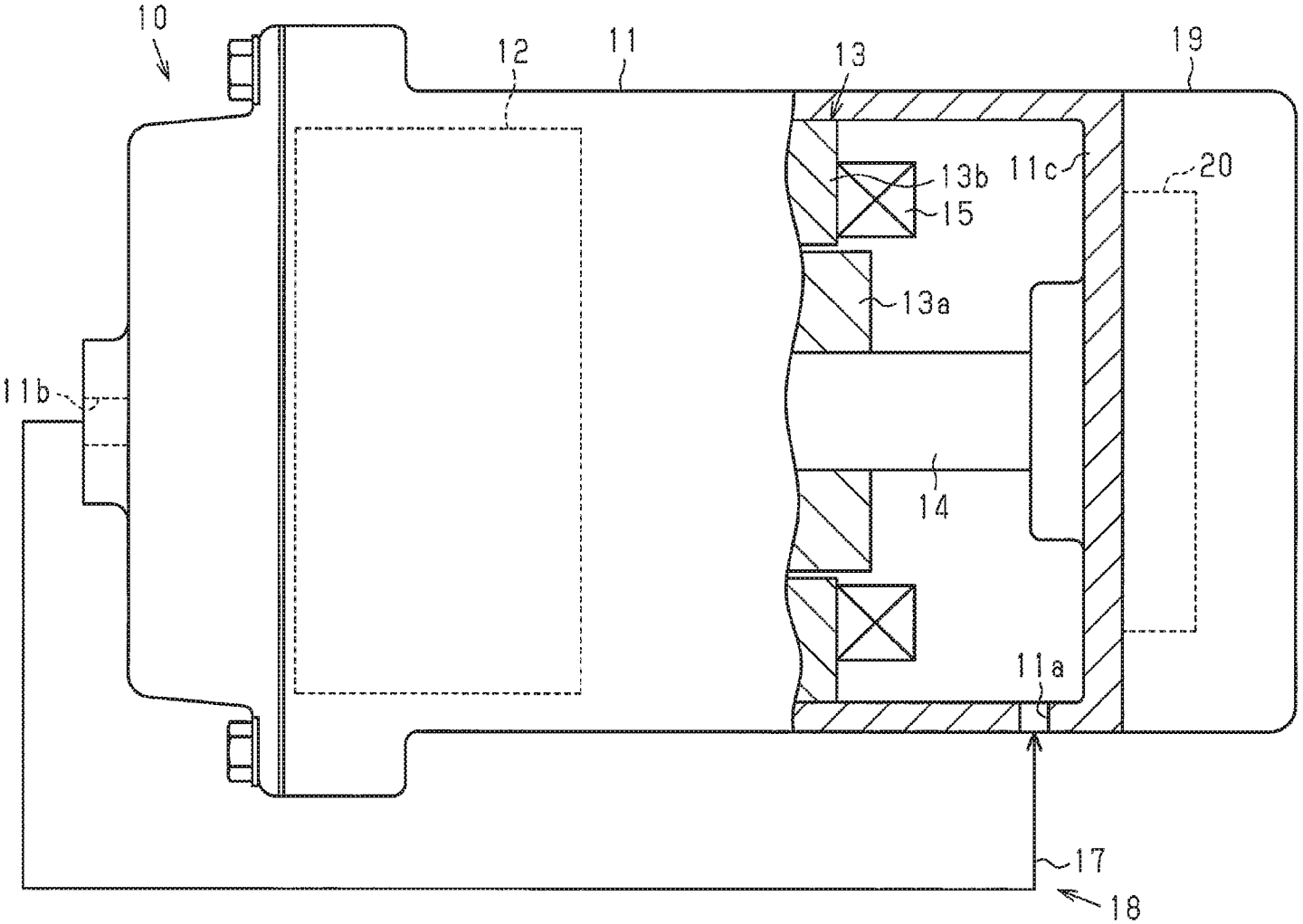
FIG. 1 is a cross-sectional view of an in-vehicle motor-driven compressor according to one embodiment.

As shown in FIG. 1, an in-vehicle motor-driven compressor 10 includes a housing 11. The housing 11 accommodates a compression unit 12 that compresses a refrigerant, which is a fluid, and an electric motor 13 that drives the compression unit 12. For example, the compression unit 12 is a scroll compressor unit including a fixed scroll (not shown) that is fixed in the housing 11 and a movable scroll (not shown) that is arranged opposing the fixed scroll. The compression unit 12 does not have to be a scroll compressor unit and may be, for example, a piston compressor unit or a vane compressor unit.

The housing 11 includes an inlet 11*a* and an outlet 11*b*. Further, the housing 11 accommodates a rotation shaft 14. The rotation shaft 14 is rotatably supported by the housing 11. The electric motor 13 includes a rotor 13*a* and a stator 13*b*. The rotor 13*a* is fixed to the rotation shaft 14 and rotated integrally with the rotation shaft 14. The stator 13*b* includes teeth and is fixed to an inner circumferential surface of the housing 11 surrounding the rotor 13*a*. Coils 15 are wound around the teeth of the stator 13*b*. Power is supplied to the coils 15 to rotate the rotor 13*a* and the rotation shaft 14.

The inlet 11*a* is connected to an end of an external refrigerant circuit 17. The outlet 11*b* is connected to the other end of the external refrigerant circuit 17. The refrigerant is drawn from the external refrigerant circuit 17 through the inlet 11*a* into the housing 11. The compression unit 12 compresses the refrigerant drawn into the housing 11. The refrigerant compressed by the compression unit 12 is discharged from the outlet 11*b* to the external refrigerant circuit 17 and recirculated via a heat exchanger or an expansion valve of the external refrigerant circuit 17 into the housing 11. The in-vehicle motor-driven compressor 10 and the external refrigerant circuit 17 form a vehicle air conditioner 18.

The housing 11 includes an end wall 11*c* to which an inverter cover 19 is coupled. An inverter 20 that drives the electric motor 13 is accommodated in a space defined by the inverter cover 19 and the end wall 11*c* of the housing 11. The compression unit 12, the electric motor 13, and the inverter 20 are arranged in order in an axial direction of the rotation shaft 14.

Figure 2:
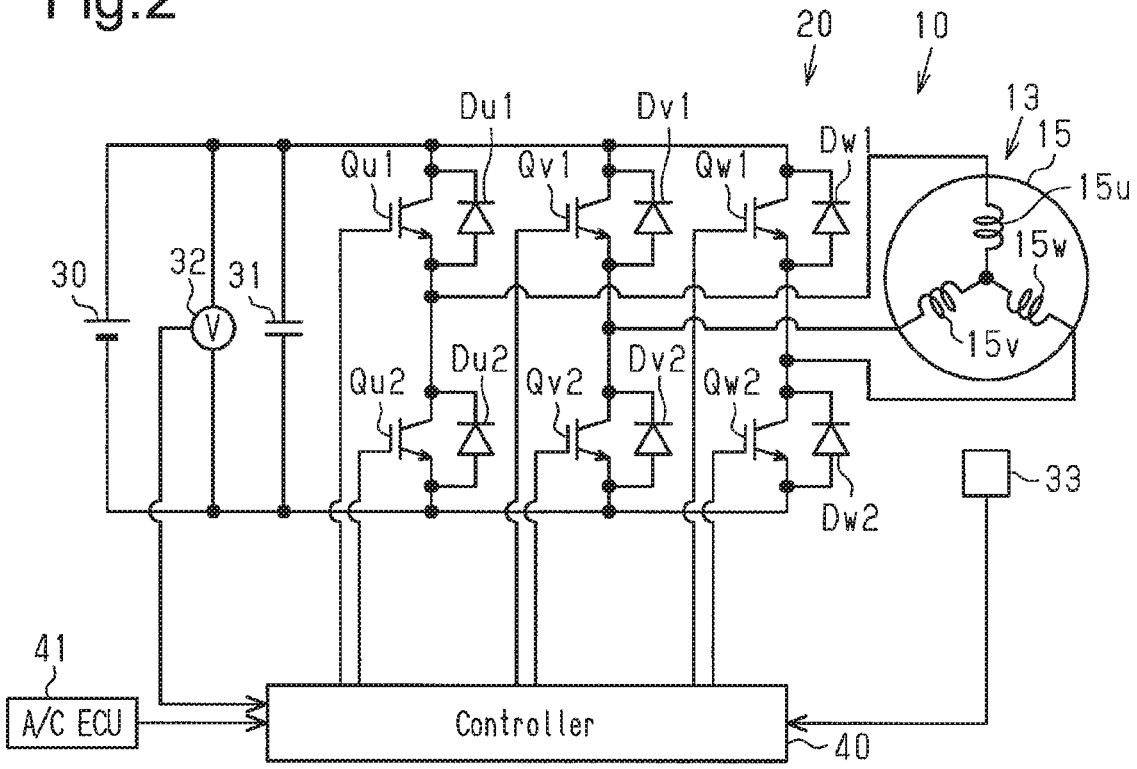
FIG. 2 is a schematic diagram showing the electric configuration of the in-vehicle motor-driven compressor shown in FIG. 1.

As shown in FIG. 2, the coils 15 of the electric motor 13 form a three-phrase construction including a u-phase coil 15*u*, a v-phase coil 15*v*, and a w-phase coil 15*w*. In the present embodiment, the u-phase coil 15*u*, the v-phase coil 15*v*, and the w-phase coil 15*w* are in a Y-connection.

The inverter 20 includes switching elements Qu1, Qu2, Qv1, Qv2, Qw1, and Qw2. The switching elements Qu1, Qu2, Qv1, Qv2, Qw1, and Qw2 perform switching to drive the electric motor 13. The switching elements Qu1, Qu2, Qv1, Qv2, Qw1, and Qw2 are, for example, insulated gate bipolar transistors (IGBT being used as power switching elements). The switching elements Qu1, Qu2, Qv1, Qv2, Qw1, and Qw2 are connected to diodes Du1, Du2, Dv1, Dv2, Dw1, and Dw2, respectively. The diodes Du1, Du2, Dv1, Dv2, Dw1, and Dw2 are connected in parallel to the switching elements Qu1, Qu2, Qv1, Qv2, Qw1, and Qw2, respectively. In the description hereafter, "the diodes Du1, Du2, Dv1, Dv2, Dw1, and Dw2" may be described as "the diodes Du1 to Dw2."

The two switching elements Qu1 and Qu2 are connected in series, the two switching elements Qv1 and Qv2 are connected in series, and the two switching elements Qw1 and Qw2 are connected in series. The switching elements Qu1, Qu2, Qv1, Qv2, Qw1, and Qw2 each include a gate that is electrically connected to a controller 40. The switching elements Qu1, Qv1, and Qv1 each include a collector that is electrically connected to the positive terminal of a vehicle battery 30. The switching elements Qu2, Qv2, and Qv2 each include an emitter that is electrically connected to the negative terminal of the vehicle battery 30. The emitter of the switching element Qu1 and the collector of the switching element Qu2 are electrically connected to the u-phase coil 15*u* via a middle point located between the two switching elements Qu1 and Qu2. The emitter of the switching element Qv1 and the collector of the switching element Qv2 are electrically connected to the v-phase coil 15*v* via a middle point located between the two switching elements Qv1 and Qv2. The emitter of the switching element Qw1 and the collector of the switching element Qw2 are electrically connected to the w-phase coil 15*w* via a middle point located between the two switching elements Qw1 and Qw2.

Further, the inverter 20 includes a capacitor 31 that is connected in parallel to the battery 30. For example, the capacitor 31 is a film capacitor or an electrolytic capacitor.

The controller 40 controls the drive voltage of the electric motor 13 through pulse width modulation control. Specifically, the controller 40 generates a pulse width modulation (PWM) signal with a high frequency triangular wave signal, which is referred to as a carrier signal, and a voltage instruction signal, which instructs a voltage. The controller 40 uses the generated PWM signals to control switching between on and off of the switching elements Qu1, Qu2, Qv1, Qv2, Qw1, and Qw2. This converts the DC voltage from the battery 30 into AC voltage. Accordingly, the switching elements Qu1, Qu2, Qv1, Qv2, Qw1, and Qw2 perform switching to convert DC voltage from the battery 30 into AC voltage. Then, the converted AC voltage is applied to the electric motor 13 as the drive voltage to drive and control the electric motor 13.

Further, the controller 40 controls the PWM signals to variably control an on-off duty ratio of the switching elements Qu1, Qu2, Qv1, Qv2, Qw1, and Qw2. This controls the rotation speed of the electric motor 13. The controller 40 is electrically connected to an air conditioner ECU 41. When information related to a target rotation speed of the electric motor 13 is received from the air conditioner ECU 41, the controller 40 rotates the electric motor 13 at the target rotation speed.

The in-vehicle motor-driven compressor 10 includes an input voltage detector 32 that detects the input voltage of the battery 30. The input voltage detector 32 is electrically connected to the controller 40 to transmit the detection result to the controller 40.

Further, the in-vehicle motor-driven compressor 10 includes a rotation speed detector 33 that detects the rotation speed of the electric motor 13. The rotation speed detector 33 is electrically connected to the controller 40 to transmit the detection result to the controller 40.

When the electric motor 13 is stopped and the voltage of the back electromotive force (back electromotive voltage) of the electric motor 13 exceeds the input voltage of the battery 30, the current that flows from the electric motor 13 via the diodes Du1 to Dw2 to the battery 30 is referred to as a reverse current. The controller 40 pre-stores a map that indicates the relationship between the reverse current and the rotation speed of the electric motor 13. Further, based on the rotation speed of the electric motor 13 detected by the rotation speed detector 33, the controller 40 is configured to calculate the reverse current expected to flow from the electric motor 13 via the diodes Du1 to Dw2 to the battery 30.

The controller 40 pre-stores a calculation program that calculates a temperature rise of the diodes Du1 to Dw2 based on the reverse current expected to flow from the electric motor 13 via the diodes Du1 to Dw2 to the battery 30, an on-voltage of the diodes Du1 to Dw2, and a heat resistance of the diodes Du1 to Dw2.

The on-voltage of the diodes Du1 to Dw2 and the heat resistance of the diodes Du1 to Dw2 are fixed values determined in advance from the characteristics of the diodes Du1 to Dw2. The on-voltage of the diodes Du1 to Dw2 is the voltage between an anode and a cathode of the diodes Du1 to Dw2. More specifically, the on-voltage of the diodes Du1 to Dw2 is a voltage between the anode and cathode of the diodes Du1 to Dw2 when a voltage is applied to the diodes Du1 to Dw2 in a forward direction and a current starts flowing. The controller 40 pre-stores the on-voltage of the diodes Du1 to Dw2 and the heat resistance of the diodes Du1 to Dw2.

When the electric motor 13 is stopped and the back electromotive voltage of the electric motor 13 exceeds the input voltage of the battery 30, the current flowing from the electric motor 13 via the diodes Du1 to Dw2 to the battery 30 is the reverse current. The controller 40 is configured to estimate the temperature rise of the diodes Du1 to Dw2 based on the expected reverse current, the on-voltage of the diodes Du1 to Dw2, and the heat resistance of the diodes Du1 to Dw2. Accordingly, the controller 40 corresponds to a temperature rise estimator.

The controller 40 pre-stores a map that indicates the relationship between the calculated temperature rise of the diodes Du1 to Dw2 and a rotation speed limit of the electric motor 13. Additionally, the controller 40 pre-stores a junction temperature of the diodes Du1 to Dw2. The controller 40 limits the rotation speed of the electric motor 13 so that the rotation speed of the electric motor 13 does not exceed a set rotation speed limit. That is, the controller 40 limits the rotation speed of the electric motor 13 to lower than or equal to the set rotation speed limit. Accordingly, the controller 40 sets the rotation speed limit of the electric motor 13 based on the calculated temperature rise of the diodes Du1 to Dw2 and limits the rotation speed of the electric motor 13 so that the rotation speed of the electric motor 13 does not exceed the set rotation speed limit. Thus, the controller 40 also corresponds to a rotation speed controller.

The operation of the present embodiment will now be described.

The controller 40 calculates the temperature rise of the diodes Du1 to Dw2 based on the reverse current that is expected to flow from the electric motor 13 via the diodes Du1 to Dw2 to the battery 30, the on-voltage of the diodes Du1 to Dw2, and the heat resistance of the diodes Du1 to Dw2.

Subsequently, the controller 40 sets the rotation speed limit of the electric motor 13 based on the calculated temperature rise of the diodes Du1 to Dw2 so that the temperature of the diodes Du1 to Dw2 does not exceed the junction temperature of the diodes Du1 to Dw2 even when the electric motor 13 is stopped and the reverse current flows through the diodes Du1 to Dw2. Further, the controller 40 limits the rotation speed of the electric motor 13 so that the rotation speed of the electric motor 13 does not exceed the set the rotation speed limit.

Power is supplied from the battery 30 of the vehicle. Thus, the in-vehicle motor-driven compressor 10 is affected by the input voltage of the battery 30. The voltage of battery 30 changes in accordance with the condition of the vehicle. The input voltage that is input from the battery 30 to the in-vehicle motor-driven compressor 10 may be decreased. When the input voltage of the battery 30 is low and the electric motor 13 is stopped while operating at a high rotation speed, the voltage of the back electromotive force (back electromotive voltage) of the electric motor 13 will exceed the input voltage of the battery 30. This will cause reverse current to flow from the electric motor 13 via the inverter 20 to the battery 30. Specifically, when the electric motor 13 is stopped, the switching elements Qu1, Qu2, Qv1, Qv2, Qw1, and Qw2 do not perform switching. Thus, the reverse current will flow from the electric motor 13 via the diodes Du1 to Dw2 to the battery 30.

Figure 3:
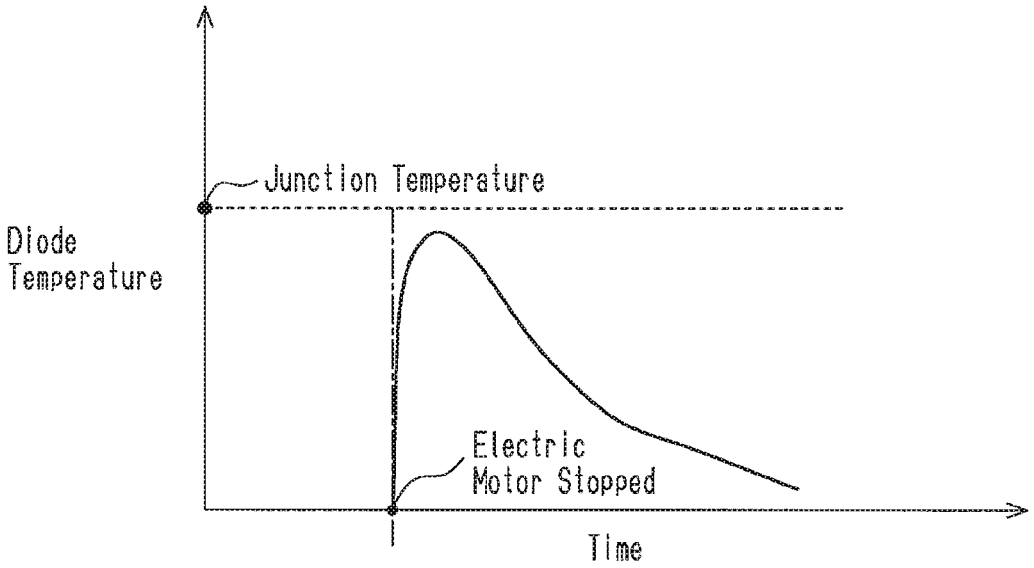
FIG. 3 is a graph indicating changes in the temperature of diodes when a reverse current flows through the diodes.

FIG. 3 shows changes in the temperature of the diodes Du1 to Dw2 resulting from the reverse current flowing through the diodes Du1 to Dw2. As shown in FIG. 3, when reverse current flows through the diodes Du1 to Dw2, the temperature of the diodes Du1 to Dw2 sharply rises.

The controller 40 sets the rotation speed limit of the electric motor 13 based on the calculated temperature rise of the diodes Du1 to Dw2 so that the temperature of the diodes Du1 to Dw2 does not exceed the junction temperature of the diodes Du1 to Dw2 even when the electric motor 13 is stopped and the reverse current flows through the diodes Du1 to Dw2. Further, the controller 40 limits the rotation speed of the electric motor 13 so that the rotation speed of the electric motor 13 does not exceed the set rotation speed limit. Thus, as shown in FIG. 3, the temperature of the diodes Du1 to Dw2 does not exceed the junction temperature of the diodes Du1 to Dw2 even when the reverse current flowing through the diodes Du1 to Dw2 sharply raises the temperature of the diodes Du1 to Dw2.

Figure 4:
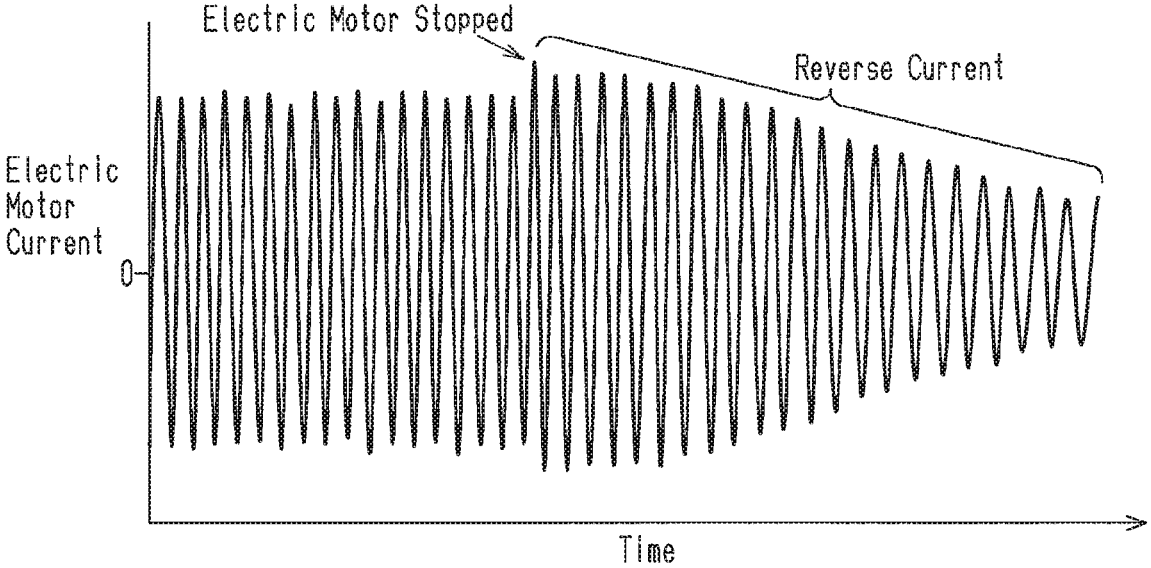
FIG. 4 is a graph indicating changes in a current flowing through an electric motor.

As shown in FIG. 4, the reverse current flowing through the diodes Du1 to Dw2 gradually decreases after the electric motor 13 is stopped. Accordingly, as shown in FIG. 3, the temperature of the diodes Du1 to Dw2 also gradually decreases. This avoids breakage of the diodes Du1 to Dw2.

The above embodiment has the advantages described below.

(1) The controller 40 sets the rotation speed limit of the electric motor 13 based on the calculated temperature rise of the diodes Du1 to Dw2 in order to avoid breakage of the diodes Du1 to Dw2. Further, the controller 40 limits the rotation speed of the electric motor 13 so that the rotation speed of the electric motor 13 does not exceed the rotation speed limit. For example, in order to avoid breakage of the diodes Du1 to Dw2, the maximum rotation speed limit of the electric motor 13 may be set in accordance with the input voltage of the battery 30. In contrast, the above embodiment does not set the maximum rotation speed limit of the electric motor 13 in accordance with the input voltage of the battery 30 when more power can be supplied from the battery 30 to the in-vehicle motor-driven compressor 10. Thus, the above embodiment widens the operation range of the in-vehicle motor-driven compressor 10 and avoids breakage of the diodes Du1 to Dw2 when the input voltage of the battery 30 is low and the electric motor 13 is stopped while operating at a high rotation speed.

It should be apparent to those skilled in the art that the present invention may be embodied in many other specific forms without departing from the spirit or scope of the invention. Particularly, it should be understood that the present invention may be embodied in the following forms. The above embodiment may be modified as described below.

Figure 5:
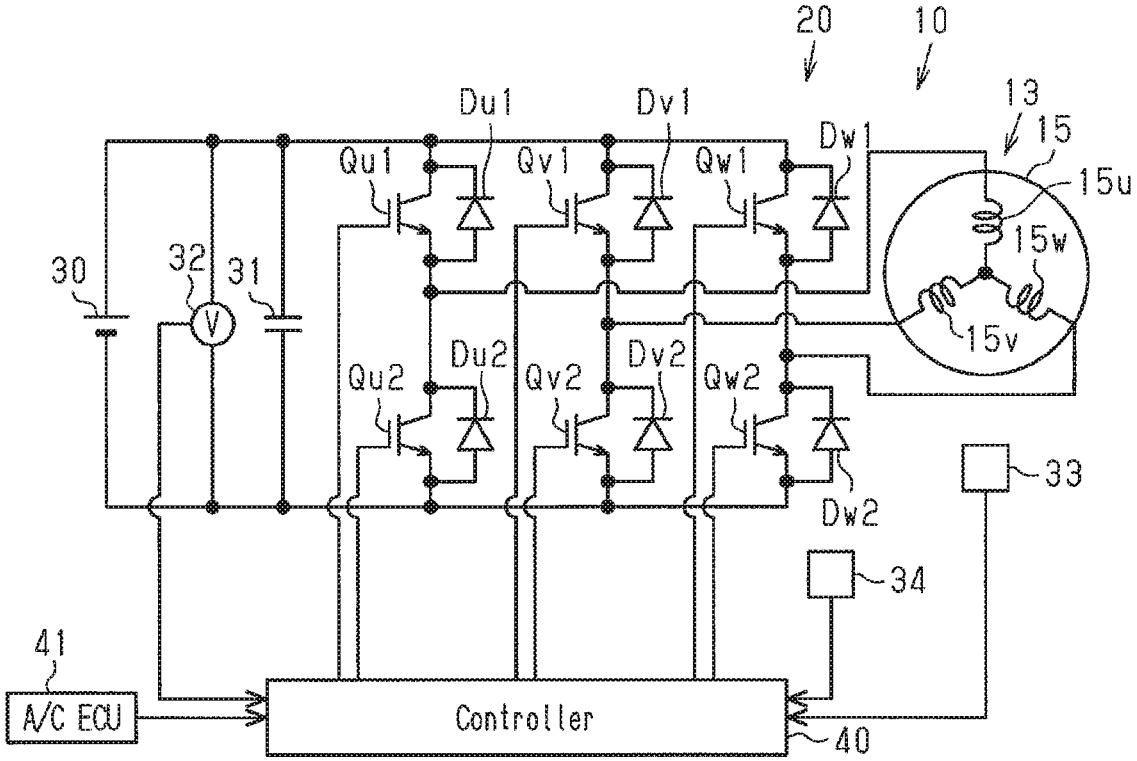
FIG. 5 is a schematic diagram showing the electric configuration of an in-vehicle motor-driven compressor according to another embodiment.

As shown in FIG. 5, the in-vehicle motor-driven compressor 10 may include a temperature detector 34 that detects the temperature of the diodes Du1 to Dw2. The temperature detector 34 is electrically connected to the controller 40 to transmit the detection result to the controller 40. Thus, the temperature detector 34 corresponds to a temperature estimator that estimates the temperature of the diodes Du1 to Dw2.

When the temperature of the diodes Du1 to Dw2 detected by the temperature detector 34 is lower than a predetermined temperature that is lower than the junction temperature of the diodes Du1 to Dw2, the controller 40 increases the rotation speed limit of the electric motor 13. Further, when the temperature of the diodes Du1 to Dw2 detected by the temperature detector 34 is higher than the predetermined temperature, the controller 40 lowers the rotation speed limit of the electric motor 13.

Accordingly, the rotation speed limit of the electric motor 13 can be changed based on the temperature of the diodes Du1 to Dw2 detected by the temperature detector 34. For example, when the temperature of the diodes Du1 to Dw2 is lower than the predetermined temperature, the margin is relatively large from the temperature of the diodes Du1 to Dw2 to the junction temperature of the diodes Du1 to Dw2. Accordingly, the controller 40 can further increase the rotation speed limit of the electric motor 13. This further widens the operation range of the in-vehicle motor-driven compressor 10. Moreover, when the temperature of the diodes Du1 to Dw2 is higher than the predetermined temperature, the margin is relatively small from the temperature of the diodes Du1 to Dw2 to the junction temperature of the diodes Du1 to Dw2. Accordingly, the controller 40 decreases the rotation speed limit of the electric motor 13 to sufficiently avoid breakage of the diodes Du1 to Dw2.

In the embodiment shown in FIG. 5, the temperature detector 34 may detect the temperature near the diodes Du1 to Dw2. Based on the temperature detected by the temperature detector 34, the controller 40 may estimate the temperature of the diodes Du1 to Dw2. In this case, the controller 40 and the temperature detector 34 correspond to a temperature estimator that estimates the temperature of the diodes Du1 to Dw2.

In the embodiment, the in-vehicle motor-driven compressor 10 may be configured so that the inverter 20 is located outward in a radial direction of the rotation shaft 14 relative to the housing 11. That is, the compression unit 12, the electric motor 13, and the inverter 20 do not have to be arranged in order in the axial direction of the rotation shaft 14.

In the embodiment, the in-vehicle motor-driven compressor 10 forms the vehicle air conditioner 18. Instead, for example, the in-vehicle motor-driven compressor 10 may be mounted in a fuel cell vehicle with the compression unit 12 compressing air that serves as a fluid supplied to the fuel cell.

In the embodiment, the in-vehicle motor-driven compressor 10 includes the rotation speed detector 33 that detects the rotation speed of the electric motor 13 and transmits the detection results of the rotation speed detector 33 to the controller 40. However, the in-vehicle motor-driven compressor 10 does not have to include the rotation speed detector 33. Instead of detecting the rotation speed of the electric motor 13, the in-vehicle motor-driven compressor 10 may estimate the rotation speed of the electric motor 13. For example, the in-vehicle motor-driven compressor 10 may perform position sensorless control to estimate the position of the electric motor 13. Then, the in-vehicle motor-driven compressor 10 may estimate the rotation speed of the electric motor 13 from an integrated value of the position deviation of a rotor of the electric motor 13 between the present position and the position in a proceeding cycle. The estimated rotation speed may be transmitted to the controller 40.

The controller 40 (more specifically, temperature rise estimator, rotation speed controller, and temperature estimator) can be circuitry that includes 1) at least one processor running on a computer program (software), 2) at least one exclusive hardware circuit such as an application specific integrated circuit (ASIC) to execute at least part of a process, or 3) a combination of the above. A processor includes a CPU and a memory such as a RAM and a ROM. The memory stores program codes or commands that are configured to have the CPU execute processes. The memory, which is a computer readable medium, may be any available medium that is accessible by a versatile or dedicated computer.

The present examples and embodiments are to be considered as illustrative and not restrictive, and the invention is not to be limited to the details given herein, but may be modified within the scope and equivalence of the appended claims.

What is claimed is:

1. An in-vehicle motor-driven compressor, comprising:

a compression unit configured to compress a fluid;

an electric motor configured to drive the compression unit; and an inverter configured to drive the electric motor, wherein the inverter includes a switching element that is configured to perform switching and convert DC voltage of a battery into AC voltage to drive the electric motor and a diode that is connected in parallel to the switching element, and the in-vehicle motor-driven compressor further includes a temperature rise estimator configured to estimate a temperature rise of the diode based on an expected reverse current, an on-voltage of the diode, and a heat resistance of the diode, wherein the reverse current is a current that flows from the electric motor via the diode to the battery when the electric motor is stopped and a back electromotive voltage of the electric motor exceeds an input voltage of the battery, and a rotation speed controller configured to set a rotation speed limit of the electric motor, based on the estimated temperature rise of the diode so that a temperature of the diode does not exceed a junction temperature of the diode even when the electric motor is stopped and the reverse current flows through the diode, and limit a rotation speed of the electric motor to lower than or equal to the rotation speed limit.

2. The in-vehicle motor-driven compressor according to claim 1, further comprising:

a temperature estimator configured to estimate the temperature of the diode, wherein the rotation speed controller is configured to increase the rotation speed limit when the temperature of the diode estimated by the temperature estimator is lower than a predetermined temperature that is lower than the junction temperature, and decrease the rotation speed limit when the temperature of the diode estimated by the temperature estimator is higher than the predetermined temperature.

3. A method for controlling an in-vehicle motor-driven compressor, wherein the in-vehicle motor-driven compressor includes a compression unit configured to compress a fluid, an electric motor configured to drive the compression unit, and an inverter configured to drive the electric motor, wherein the inverter includes a switching element that is configured to perform switching and convert DC voltage of a battery into AC voltage to drive the electric motor and a diode that is connected in parallel to the switching element, the method comprising:

estimating a temperature rise of the diode based on an expected reverse current, an on-voltage of the diode, and a heat resistance of the diode, wherein the reverse current is a current that flows from the electric motor via the diode to the battery when the electric motor is stopped and a back electromotive voltage of the electric motor exceeds an input voltage of the battery;

setting a rotation speed limit of the electric motor based on the estimated temperature rise of the diode so that a temperature of the diode does not exceed a junction temperature of the diode even when the electric motor is stopped and the reverse current flows through the diode; and limiting a rotation speed of the electric motor to lower than or equal to the rotation speed limit.

4. An in-vehicle motor-driven compressor, comprising:

a compression unit configured to compress a fluid;

an electric motor configured to drive the compression unit; and an inverter configured to drive the electric motor, wherein the inverter includes a switching element that is configured to perform switching and convert DC voltage of a battery into AC voltage to drive the electric motor and a diode that is connected in parallel to the switching element, and the in-vehicle motor-driven compressor includes circuitry configured to estimate a temperature rise of the diode based on an expected reverse current, an on-voltage of the diode, and a heat resistance of the diode, wherein the reverse current is a current that flows from the electric motor via the diode to the battery when the electric motor is stopped and a back electromotive voltage of the electric motor exceeds an input voltage of the battery, and the circuitry is configured to set a rotation speed limit of the electric motor, based on the estimated temperature rise of the diode so that a temperature of the diode does not exceed a junction temperature of the diode even when the electric motor is stopped and the reverse current flows through the diode, and limit a rotation speed of the electric motor to lower than or equal to the rotation speed limit.

* * * * *